United States Patent [19]

Tsuchihashi

[11] 4,169,404

[45] Oct. 2, 1979

[54] FLUID PRESSURE ACTUATOR

[75] Inventor: Akira Tsuchihashi, Nagareyama, Japan

[73] Assignee: Hitachi, Ltd., Japan

[21] Appl. No.: 891,625

[22] Filed: Mar. 30, 1978

[51] Int. Cl.[2] ..... F01B 13/00

[52] U.S. Cl. ..... 91/61; 91/508; 60/484; 60/DIG. 10

[58] Field of Search ..... 91/411 R, 61; 74/480 R, 74/471 XY; 214/1 CM; 60/484, 483, DIG. 10

[56] References Cited

U.S. PATENT DOCUMENTS

| | | | |
|---|---|---|---|
| 2,860,751 | 11/1958 | Seigle | 74/471 XY |
| 2,988,928 | 6/1961 | DeFonbrune et al. | 74/471 XY |

FOREIGN PATENT DOCUMENTS

| | | | |
|---|---|---|---|
| 51-12081 | 1/1976 | Japan | 60/DIG. 10 |
| 51-111578 | 10/1976 | Japan | 60/DIG. 10 |
| 52-117787 | 9/1977 | Japan | 60/DIG. 10 |

*Primary Examiner*—Edgar W. Geoghegan
*Attorney, Agent, or Firm*—Craig and Antonelli

[57] ABSTRACT

A fluid pressure actuator having a first member, a second member adapted to rotate relative to the first member, and a third member adapted to move on the second member. One of the first member and the second member is formed thereon with two flanges disposed in spaced-apart relationship for closing opposite ends of a first pressure chamber defined between the first and second members. The flanges are each formed in the outer periphery thereof with a groove communicating with passages formed in the first and second members for supplying therethrough power for moving the third member. The actuator is small in volume, dispenses with piping located outside the actuator, and is easy to provide a fluid seal thereto.

4 Claims, 2 Drawing Figures

FLUID PRESSURE ACTUATOR

LIST OF THE PRIOR ART REFERENCES [37 CFR 1.56 (a)]

The following references are cited to show the state of the art:

Japanese Patent Laid-open Publication No. 12081/76 (Jan. 30, 1976)

Japanese Patent Laid-open Publication No. 111578/76 (Oct. 1, 1976)

Japanese Utility Model Laid-open Publication No. 117787/77 (Sept. 7, 1977)

BACKGROUND OF THE INVENTION

This invention relates to multistage fluid pressure actuators, and more particularly the invention is concerned with an actuator of the class described in which a rotational movement takes place at the first stage.

In industrial robots and machine tools, a structural arrangement in which a first member supports a second member for movement and the second member in turn supports a third member for movement has hitherto had many applications. In this structural arrangement, a first drive means for driving the second member is fixedly secured to the first member and a second drive means for driving the third member is fixedly secured to the second member in many applications. With regard to a method for supplying fluid power to the first and second drive means, no difficulty is encountered in supplying fluid power to the first drive means if the first member is a base, for example, which is fixed in place, because the first drive means does not move. However, it is not easy to transmit fluid power to the second drive means because the second member to which the second drive means is fixedly secured undergoes some sort of movement.

In many cases, flexible pipes have hitherto been used for transmitting fluid power to drive means subjected to movement. When pipes are used for this purpose, it is necessary to select for them positions in which they are arranged in such a manner that their pressure does not interfere with the operation of the apparatus. Selection of such positions raises a problem which is hard to solve from the point of view of design. Moreover, since repeated stress is applied to the pipes, the pipes tend to be damaged, thereby making it necessary to perform inspection often to keep them in good working conditions.

The fluid pressure actuators disclosed in Japanese Patent Laid-open Publication No. 12081/76, Japanese Patent Laid-open Publication No. 111578/76 and Japanese Utility Model Laid-open Publication No. 117787/77 are constructed such that a fluid is supplied through passages formed in a first member and a second member to the second member and a third member for moving the same, thereby dispensing with piping located outside the actuators. Generally, fluid pressure actuators including those of the prior art described hereinabove have a large number of parts which require precise machine finishes in production.

SUMMARY OF THE INVENTION

An object of the present invention is to provide a fluid pressure actuator which has a minimum number of parts requiring precise machine finishes and which is of simple and inexpensive construction.

Another object is to provide a fluid pressure actuator which offers little resistance during operation.

The outstanding characteristics of the invention are as follows. A first pressure chamber is defined between a first member and a second member and is closed at opposite ends thereof by two flanges formed in spaced-apart relationship on one of the first and second members. A drain collecting chamber is located opposite to the first pressure chamber with respect to each of the flanges, and the fluid leaking past the flanges from the first pressure chamber into the drain collecting chambers is discharged to outside through a drain passage formed in the first member. Thus, ordinarily, no precise machine finish is tolerated in fabricating the flanges, which are each formed in the outer periphery thereof with a groove communicating with passages formed in the first and second members for supplying therethrough fluid for moving a third member. Since a thin film of fluid is formed on the surface of each of the flanges, the fluid pressure actuator according to the invention offers little resistance during operation. The provision of the drain collecting chambers enables a fluid seal to be readily provided to a portion of the second member through which the first member extends.

DESCRIPTION OF THE PREFERRED EMBODIMENT

Figure 1:
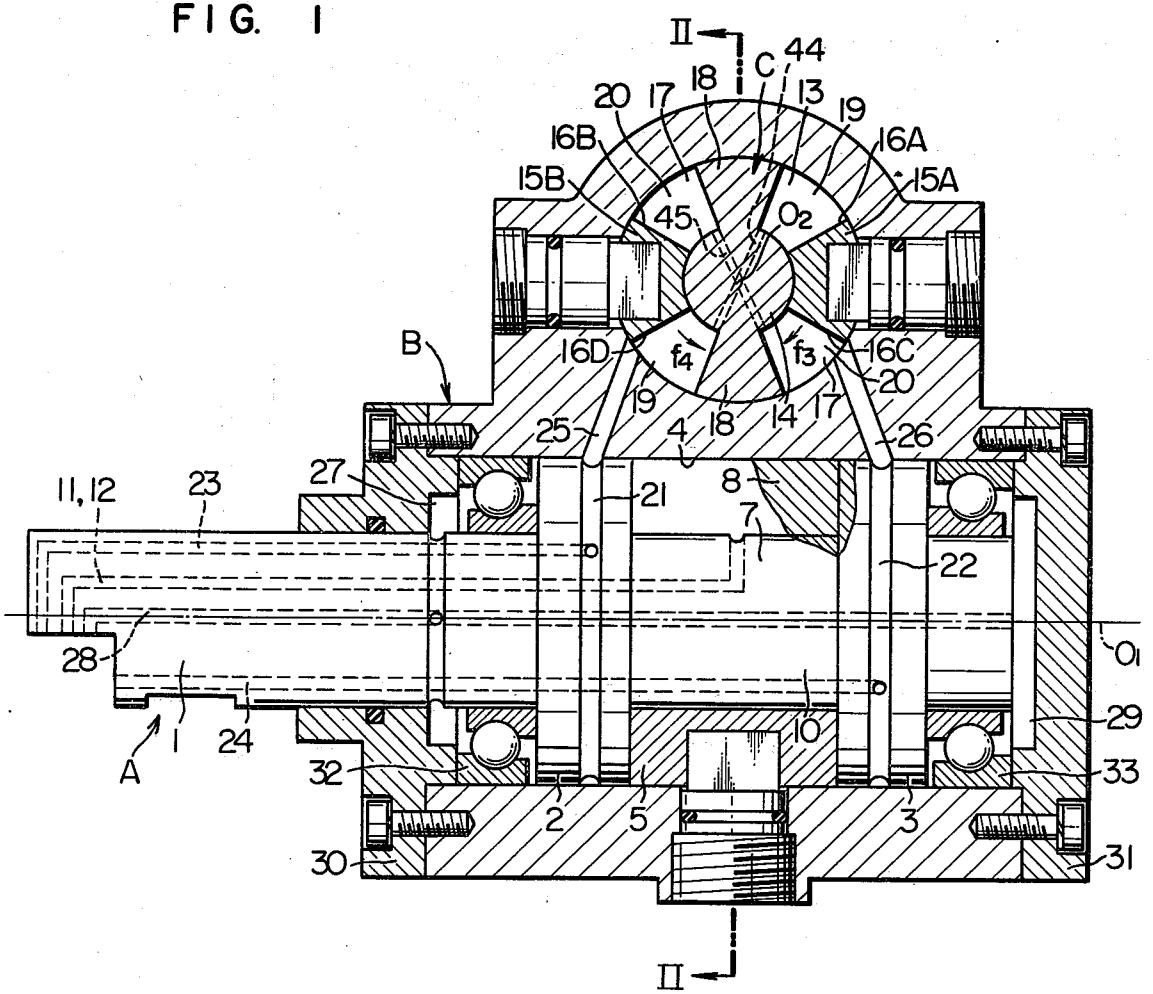
FIG. 1 is a vertical sectional view of the fluid pressure actuator comprising one embodiment of the invention.
Figure 2:
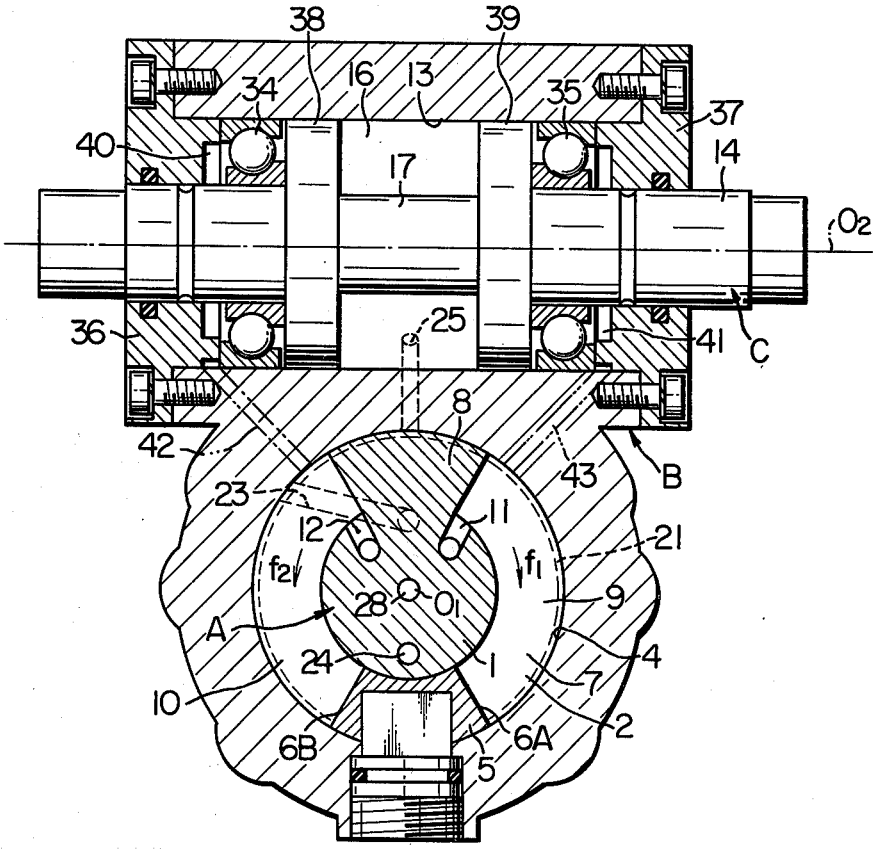
FIG. 2 is a sectional view taken along the line II—II in FIG. 1 and seen in the direction of arrows.

In FIGS. 1 and 2, the fluid pressure actuator according to the invention includes a first member A, a second member B and a third member C. The second member B is capable of rotating both in a direction indicated by an arrow $f_1$ and in a direction indicated by an arrow $f_2$ about the center axis $O_1$ of the first member A relative thereto. The third member C is capable of rotating both in a direction indicated by an arrow $f_3$ and in a direction indicated by an arrow $f_4$ about the center axis $O_2$ thereof relative to the second member B. The axes $O_1$ and $O_2$ are located, parallel to but perpendicularly to each other.

The first member A includes a shaft 1 formed thereon with a first flange 2 and a second flange 3 located in spaced-apart relationship. The second member B is formed therein with a cylindrical bore 4 in which the first and second flanges 2 and 3 are fitted.

The second member B has mounted therein a partition plate 5 located between the first and second flanges 2 and 3 and extending radially inwardly to the first member A so as to define between the first and second members A and B a first pressure chamber 7 of a circularly arcuate shape having ends 6A and 6B as seen in the directions of the arrows $f_1$ and $f_2$ respectively. The first pressure chamber 7 is divided into a first compartment 9 and a second compartment 10 by a first partition 8 which is integral with the first member A. A first passage 11 is provided for communicating the first compartment 9 with a fluid pressure generating means, not shown, while a fifth passage 12 is provided for communicating the second compartment 10 with the fluid pressure generating means. The first and fifth passages 11 and 12 are formed in the first member A. Thus, by supplying a fluid under pressure to the first compartment 9, it is possible to cause the second member B to rotate in the direction of the arrow $f_1$, and by supplying a fluid under pressure to the second compartment 10, it is possible to cause the second member B to rotate in the direction of the arrow $f_2$.

The second member B is formed therein with a through bore 13 which is located perpendicularly to the axis of the shaft 1 of the first member A. The third member C includes a shaft 14 formed thereon with a third flange 38 and a fourth flange 39 located in spaced-apart relationship and fitted in the through bore 13 to enable the shaft 14 to rotate. The second member B has mounted therein two partition plates 15A and 15B located between the third and fourth flanges 38 and 39 and extending radially inwardly to the third member C so as to define between the second and third members B and C two second pressure chambers 17, 17 surrounding the shaft 14. The second pressure chambers 17, 17 have ends 16A, 16B and 16C, 16D as seen in the directions of the arrows $f_3$ and $f_4$ respectively. Each of the second pressure chambers 17, 17 is divided by one of two second partitions 18 integral with the shaft 14 into two third compartments 19 and two fourth compartments 20.

The first flange 2 and the second flange 3 are formed with a second passage 21 and a sixth passage 22 of an annular shape respectively which are concentric with the cylindrical bore 4 and located in positions in which the outer peripheral surfaces of the flanges 2 and 3 are in contact with the wall of the cylindrical bore 4. The first member A is formed therein with a third passage 23 for communicating the second passage 21 with the fluid pressure generating means, and with a seventh passage 24 for communicating the sixth passage 22 with the fluid pressure generating means.

The second member B is formed with a fourth passage 25 for communicating the second passage 21 with the third compartments 19, 19, and with an eighth passage 26 for communicating the sixth passage 22 with the fourth compartments 20, 20.

An annular chamber 27 concentric with the cylindrical bore 4 is formed and located in a position which is opposite the second flange 3 with respect to the second passage 21. A drain passage 28 communicating with the annular chamber 27 is formed in the first member A. A chamber 29 is formed and located in a position which is opposite the first flange 2 with respect to the sixth passage 22, and is maintained in communication with the drain passage 28. The cylindrical bore 4 is closed at opposite ends thereof by end plates 30 and 31. The numerals 32, 33, 34 and 35 designate bearings. The through bore 13 is closed at opposite ends thereof by end plates 36 and 37. The numerals 44 and 45 designate passages for interconnecting the third compartments 19, 19 and the fourth compartments 20, 20 respectively. The numerals 40 and 41 designate drain collecting chambers which are maintained in communication with the drain collecting chambers 27 and 29 through passages 42 and 43 respectively.

In operation, when it is desired to rotate the second member B in the direction indicated by the arrow $f_1$, a fluid is supplied under pressure to the first compartment 9 through the first passage 11. The fluid pressure within the first compartment causes the second member B to rotate, together with the third member C, in the direction indicated by the arrow $f_1$.

When it is desired to rotate the second member B in the direction indicated by the arrow $f_2$, the fluid is supplied under pressure to the second compartment 10 through the fifth passage 12. The fluid pressure within the second compartment 10 causes the second member B to rotate, together with the third member C, in the direction indicated by the arrow $f_2$. To rotate the third member C in the direction indicated by the arrow $f_4$ only requires the supply of the fluid under pressure to the third compartments 19, 19 through the third passage 23, second passage 21 and fourth passage 25. In this case, since the second passage 21 is annular in shape and located between the first member A and second member B, the third passage 23 and third compartments 19, 19 are brought into communication with each other, no matter what the relative positions of the first member A and second member B may be.

To rotate the third member C in the direction indicated by the arrow $f_3$ only requires the supply of the fluid under pressure to the fourth compartments 20, 20 through the seventh passage 24, sixth passage 22 and eighth passage 26. In this case, since the sixth passage 22 is annular in shape and located between the first member A and second member B, the seventh passage 24 and the fourth compartments 20, 20 are brought into communication with each other, no matter what the relative positions of the first member A and second member B may be.

The fluid leaking from the second and sixth passages 21 and 22 and finding its way into the annular chambers 27 and 29 is discharged from the actuator to outside through the drain passage 28.

In the embodiment shown and described hereinabove, the third member C has been described as moving in rotational movement relative to the second member B. It is to be understood, however, that the invention is not limited to this form of movement of the third member C and that the third member C can be made to rectilinearly and reciprocally move relative to the second member B if the actuator is constructed as described in Japanese Patent Laid-open Publication No. 12081/76.

Also, in the embodiment shown and described hereinabove, passages 11, 26 communicating with the first compartment 9 and fourth compartments 20 are separately provided and the second member B and third member C are caused to operate by the fluid supplied under pressure to the first compartment 9 and fourth compartments 20 through these passages 11, 26. The embodiment can be modified as described hereinbelow without departing from the scope of the invention. In such modification, resilient means (not shown) urging the second member B and the third member C by biasing forces to rotate them in the directions indicated by the arrows $f_2$ and $f_3$ may be mounted in the second compartment 10 and fourth compartments 20, 20 respectively. Thus the movement of the second member B and third member C in the directions indicated by the arrows $f_2$ and $f_3$ respectively are effected by the biasing forces of the resilient means.

In this construction, the second member B stops rotating in a position in which the biasing force of the resilient means mounted in the second compartment 10 and the pressure of the fluid supplied to the first compartment 9 balance, and the third member C stops movement in a position in which the biasing force of the resilient means mounted in the fourth compartments 20, 20 and the pressure of the fluid supplied to the third compartments 19, 19 balance. This construction reduces the number of passages required for supplying a fluid under pressure to the second and third members B and C, thereby facilitating the fabrication of the actuator.

The second passage 21 has been shown and described as being annular in shape. However, it is to be understood that the second passage 21 may be arcuate in shape.

In the embodiment shown and described hereinabove, the cylindrical bore 4 has been described as being formed in the second member B and the shaft 1 of the first member A has been described as being fitted in the cylindrical bore 4. It is to be understood, however, that the first member A may be formed with a cylindrical bore and a shaft provided to the second member B may be fitted in the cylindrical bore formed in the first member A.

What is claimed is:

1. A fluid pressure actuator comprising:

a first member;

a second member;

a first flange and a second flange formed and located in spaced-apart relationship on one of said first member and said second member;

a cylindrical bore formed in the other of said first member and said second member for receiving said first flange and said second flange fitted therein;

a partition plate mounted in the other of said first member and said second member and located between said first flange and said second flange in such a manner that said partition plate extends radially inwardly to said one of said first member and said second member;

a first pressure chamber of a circularly arcuate shape defined between said first member and said second member and having an end located in the direction of movement of said second member;

a first partition formed integrally with said first member for dividing said first pressure chamber into a first compartment and a second compartment;

a first passage formed in said first member for communicating said first compartment with a fluid pressure generating means so as to enable said second member to rotate relative to said first member by a fluid supplied under pressure to said first compartment through said first passage;

a second pressure chamber defined between said second member and said third member and having an end located in the direction of movement of said third member;

a second partition formed integrally with one of said second member and said third member for dividing said second pressure chamber into third compartments and fourth compartments;

a second passage of annular or arcuate shape concentric with said cylindrical bore and formed in a portion of said first flange maintained in contact with a wall of said cylindrical bore;

a third passage formed in said first member for communicating said second passage with said fluid pressure generating means;

a fourth passage formed in said second member for communicating said second passage with said third compartments so as to enable said third member to move relative to said second member when the fluid is supplied under pressure to said third compartments through said fourth passage;

an annular chamber concentric with said cylindrical bore and located opposite said second flange with respect to said second passage; and a drain passage formed in said first member and communicating with said annular chamber.

2. A fluid pressure actuator as claimed in claim 1, further comprising a fifth passage formed in said first member for communicating said second compartment with said fluid pressure generating means so as to enable said second member to rotate, when the fluid is supplied under pressure to said second compartment through said fifth passage, relative to said first member in a direction opposite to the direction in which said second member rotates when the fluid is supplied under pressure to said first compartment through said first passage.

3. A fluid pressure actuator as claimed in claim 1, further comprising a sixth passage of one of annular and circularly arcuate shapes concentric with said cylindrical bore and formed in a portion of said second flange maintained in contact with the wall of said cylindrical bore, a seventh passage formed in said first member for communicating said sixth passage with said fluid pressure generating means, and an eighth passage formed in said second member for communicating said sixth passage with said fourth compartments.

4. A fluid passage actuator as claimed in claim 1, further comprising first resilient means mounted in said second compartment for urging, by the biasing force thereof, said second member to rotate relative to said first member in a direction opposite to the direction in which said second member rotates when the fluid is supplied under pressure to said first compartment, and second resilient means mounted in said fourth compartments for urging, by the biasing force thereof, said third member to move relative to said second member in a direction opposite to the direction in which said third member moves when the fluid is supplied under pressure to said third compartments.

* * * * *